US005924646A

United States Patent [19]

Pouya

[11] Patent Number: 5,924,646

[45] Date of Patent: Jul. 20, 1999

[54] DISPLAY APPARATUS FOR CARPETS

[76] Inventor: Amir S. Pouya, 10300 Jefferson Rd., Oscealo, Ind. 46561

[21] Appl. No.: 09/062,791

[22] Filed: Apr. 20, 1998

Related U.S. Application Data

[63] Continuation-in-part of application No. 08/721,553, Sep. 26, 1996, abandoned.

[51] Int. Cl.[6] ..... B65H 18/08; B65H 39/14; B65H 18/14; G09F 11/18

[52] U.S. Cl. ..... 242/538.1; 242/528; 242/538.2; 242/541.3; 242/545; 242/563.2; 242/564.5; 242/919; 40/471

[58] Field of Search ..... 242/538.2, 528, 242/541.3, 564.5, 542.3, 532.1, 534.2, 538.1, 545, 563.2, 919; 40/471, 478, 518, 519

[56] References Cited

U.S. PATENT DOCUMENTS 4,965,947 10/1990 Zanetti ..... 40/471

5,072,533 12/1991 Doepgen et al. ..... 40/471 X 5,431,358 7/1995 Alexander, III ..... 242/564.5 X

*Primary Examiner*—John Q. Nguyen

*Attorney, Agent, or Firm*—William B. Ritchie; Michael J Persson

[57] ABSTRACT

A display apparatus employing a scrolling principle having two rollers that are activated and supported by independently controllable conveyors. The rollers, which can serve either as a supply roller or as a take-up roller, are attached to opposite sides of a conveyor display platform. The rollers are connected to each other by a traveling full width belt which winds off one roller, is transported via the conveyor display platform, and winds up on the other roller in a scrolling fashion, with carpets of display attached to the belt by a releasable device so as to allow for convenient viewing, examining, storage, and retrieval of the carpets.

13 Claims, 7 Drawing Sheets

DISPLAY APPARATUS FOR CARPETS

This application is a Continuation-in-Part of U.S. application Ser. No. 08/721,553, filed Sep. 26, 1996, now abandoned.

BACKGROUND OF THE INVENTION

1. Field of the Invention

The invention relates to an apparatus for displaying and storing difficult to handle flat, flexible, fabric floor coverings such as rugs, mats, carpets, etc. The term "carpet", as used herein, shall include all such floor coverings. The invention allows such objects to be displayed in a manner so that the carpets can be readily observed and examined in their naturally horizontally flat laying position with easy access to a large inventory of carpets in a compact space and no restrictions to the visual and physical access.

2. Description of the Related Art

Display units employing movable panels are known to the art. For example, U.S. Pat. No. 3,185,309, issued to Radek on May 25, 1969, discloses a frame containing a plurality of supporting devices which comprise two main parts: a sample holder and a supporting rack member. The rack member is in the form of an L-shaped track element in which the sample holding element is adapted to secure the top of a carpet section and is slideable. The rack member is secured to the top of a cabinet by means of bolts and the sample holder may be withdrawn carrying the carpet sample to permit visual inspection but remaining suspended from the track element. After inspection is complete, the sliding support element is pushed back into the track and some other samples may be viewed.

Another display rack for visually displaying rugs, carpet samples or other flat elements is disclosed in U.S. Pat. No. 3,883,004, issued to Slaga on May 13, 1975. This invention utilizes a sliding panel display rack having sliding, adjustable display panels. The display rack uses the cantilever principle to support the load of panels and merchandise carried. The invention permits the use of a rack, which does not require support elements such as posts at the forward corners of the rack, thus, providing better visual access to the merchandise.

Prior art display apparatus do not allow for the display of large, delicate carpets such as expensive oriental rugs in a naturally horizontally flat laying position. Display apparatus in which merchandise is displayed vertically does not allow the customer to observe the carpets in their normal horizontal orientation. Furthermore, vertical display apparatus do not allow the customer to physically walk on top of said merchandise and observe merchandise in a fashion that would simulate the actual end use appearance. Vertical display apparatus do not allow the customer access to the merchandise with absolutely no visual or physical restrictions. Furthermore, vertical display apparatus do not allow for the easy addition or retrieval of merchandise from the display apparatus without the need for great physical labor. Also, prior art display devices do not provide a compact method of storing the merchandise when it is not on display or enable storing the merchandise separate from the display rack. Merchants with limited retail space using existing devices cannot store additional merchandise in an area separate from the retail space, yet retrieve and display the merchandise easily. Most importantly, prior art display devices do not ensure that the carpets, once they have been placed in the device, will stay in their original position since movement during the displaying process may result in damage to the carpet.

Finally, prior art display apparatus do not provide a device capable of storing the merchandise in a manner, which serves to protect the merchandise from damage due to dust, water, smoke, fire, and pilferage.

SUMMARY OF THE INVENTION

It is an aspect of the invention to provide a display apparatus for carpets.

It is still another aspect of the invention to provide a display apparatus, which displays the carpets in a horizontal position.

It is still another aspect of the invention to provide a display apparatus, which supports the carpets in a horizontal position so that the display carpets can be stood upon by a prospective buyer.

Another aspect of the invention is to provide a display apparatus that maintains the carpets to be displayed in a fixed position on the display conveyor belt so that the carpets cannot be damaged by movement of the carpet relative to the conveyor belt.

It is still another aspect of the invention to provide a display apparatus, which scrolls the carpets so that a predetermined carpet can be easily selected for viewing.

It is still another aspect of the invention to provide a display apparatus, which enables the displayed carpets to be easily attached to and released from the display apparatus.

It is still another aspect of the invention to provide a display apparatus, which stores the carpets in a compact manner.

It is still another aspect of the invention to provide a display apparatus, which protects the carpets from damage due to dust, water, smoke, fire, and pilferage.

It is still another aspect of the invention to provide a display apparatus, which can accommodate the display, protection, and storage of a plurality of groups of carpets.

Another aspect of the invention is to provide a display apparatus that can be inexpensively constructed using readily available materials.

Still another aspect of the invention is to provide a display apparatus enables the carpets to be display to be wound onto a roller.

It is an aspect of the invention to provide a display apparatus that provides support for the roller while the carpets are being either wound onto or unwound from the roller so that the carpets will not be crushed.

The invention is a display apparatus, which is used for displaying a preselected carpet from among a plurality of carpets in a predetermined viewing position.

The invention is a display apparatus for displaying a plurality of carpets in a substantially horizontal position. A display sheet, having a length and a width, for supporting the plurality of carpets in the horizontal position is provided. A supply assembly is provided. The supply assembly has a roller, having a length and two ends, wherein said display belt is wound onto said roller. The supply assembly also has a stand having spaced apart vertical members wherein the ends of said roller are attached between said vertical members such that said roller is free to rotate and move in a vertical direction.

The supply assembly also features a motor-driven conveyor, connected to said stand, for supporting said roller along its length when said conveyor is being driven by its motor. A take-up assembly for winding up said display belt with the attached carpets. The display belt with the attached carpets is provided by said supply assembly.

The take-up assembly is substantially identical to said supply assembly such that take-up assembly can serve as said supply assembly when said display belt with the attached carpets is wound upon said take-up assembly, with said supply assembly then serving as said take-up assembly to transfer said display belt with the attached carpets back again to said supply assembly.

A display conveyor is provided. The display conveyor is disposed between said take-up assembly and said supply assembly. The display conveyor supports and assists the movement of said display belt with the attached carpets from said assembly to the other said assembly so that the carpets can be viewed in the horizontal position, that is, the display conveyor must be sufficiently sturdy to support the conveyor belt and the attached carpets as well as at least one user standing thereupon. The display apparatus also has indicating means for indicating the approximate point along the length of said display belt where one of said carpets is located. The take-up assembly, the supply assembly, and said display conveyor move said display belt with the attached carpets until said indicating means indicates that the approximate point along the length of said display belt where the preselected carpet is located so that said carpet can be viewed.

A steering assembly is provided to keep the conveyor belt and attached carpets from being unevenly wound on the take-up assembly if one end of the supply roller is higher than the other end. The steering assembly is also used to raise the supply roller as the conveyor belt is being unwound in order to keep a proper tension on the belt to prevent slack. This function of the steering assembly is also augmented by a brake assembly. In this manner, which serves to keep a proper tension on the belt by providing braking to the supply roller.

DETAILED DESCRIPTION OF THE INVENTION

Figure 1:
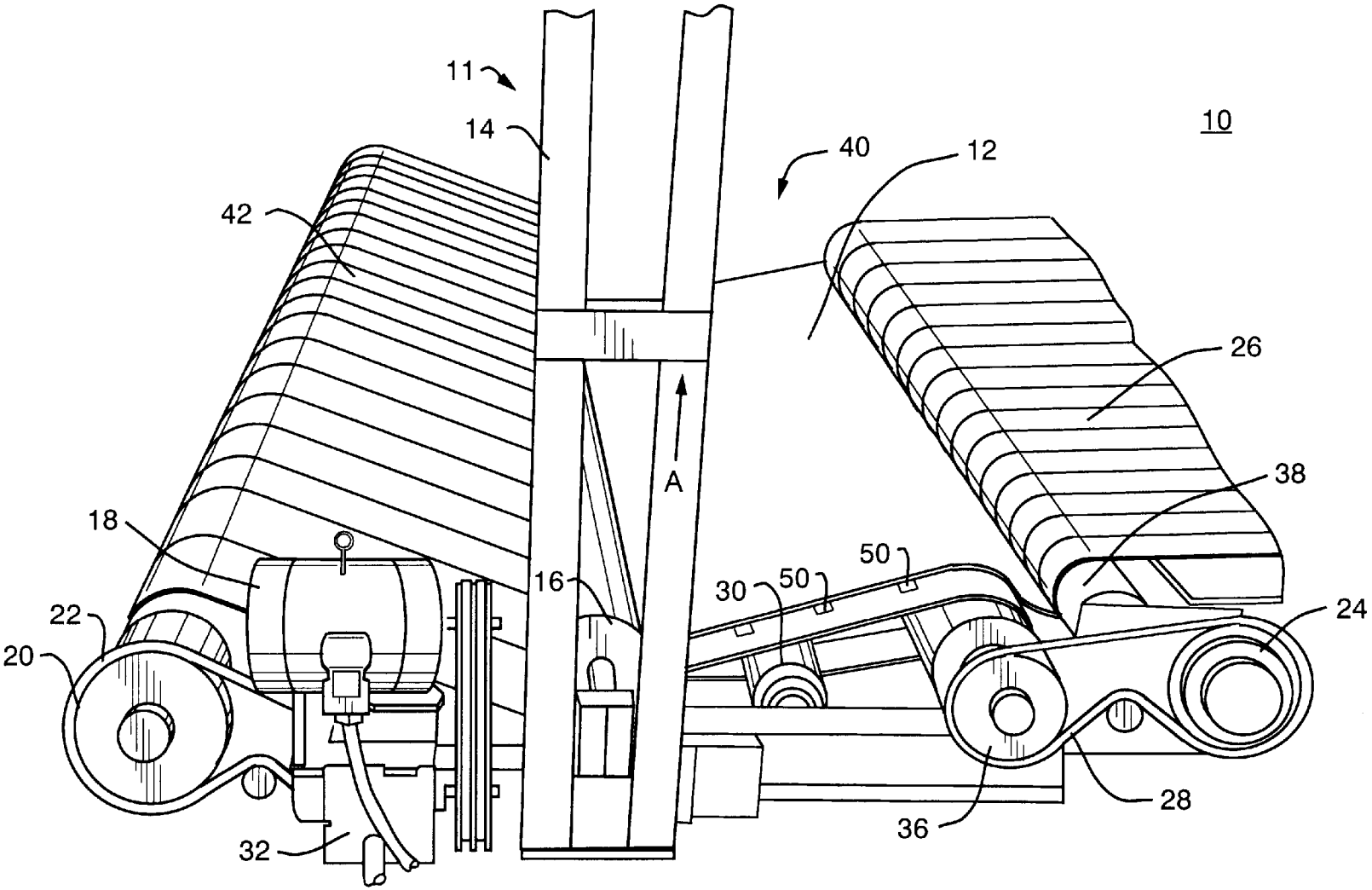
FIG. 1 is an isometric view of the display apparatus showing the supply/take-up assembly and the display conveyor.
Figure 2:
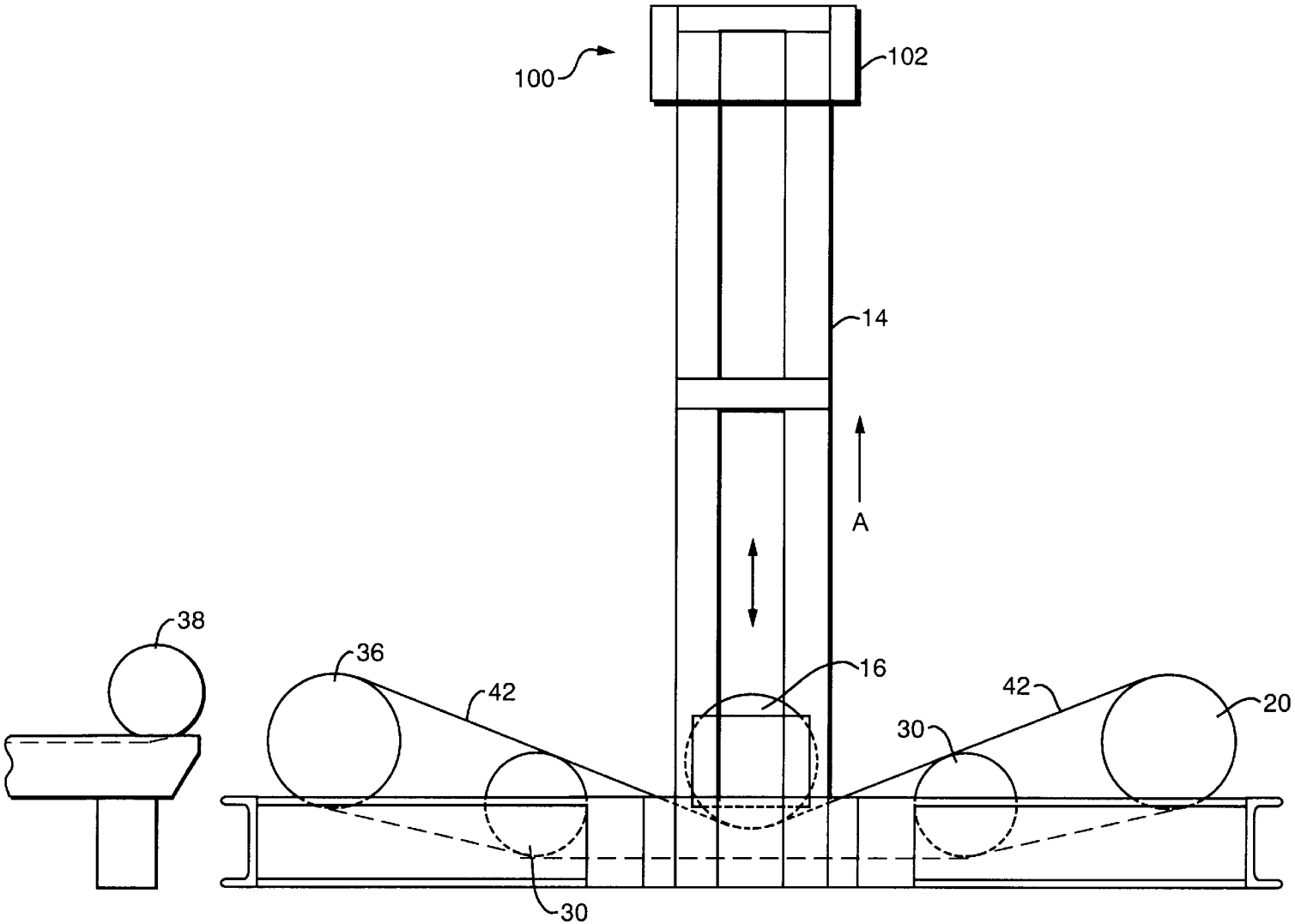
FIG. 2 is an end view of the display apparatus shown in FIG. 1.
Figure 3:
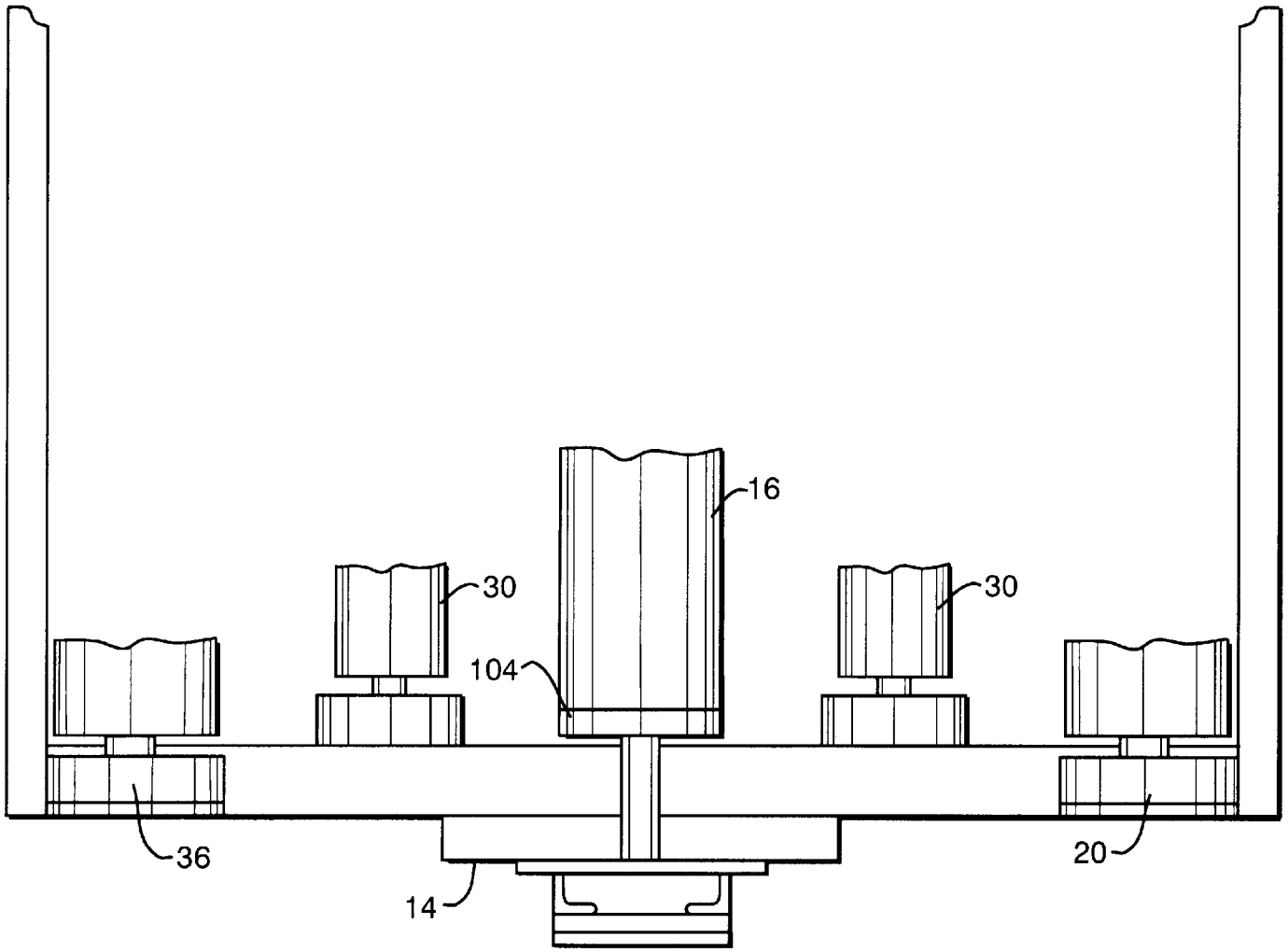
FIG. 3 is a top view of the supply/take-up assembly.

The display apparatus invention 10 comprises four basic modules or assemblies: supply assembly 11; a substantial identical take-up assembly; a display conveyor assembly 40; and a steering and brake assembly. FIG. 1 is an isometric view of the display apparatus showing the supply assembly 11 and the display conveyor 40. Steering and brake assembly 100 is shown in FIGS. 2 and 3. The supply assembly 11 is not attached to display conveyor 40 except by the connection provided by belt/chain 28. The carpets, such as oriental rugs, that are to be displayed, are positioned onto display belt 12 while it is being rolled onto roller 16. Display belt 12 is preferably about 12 feet wide and about 600 feet long, which provides the ability to store a substantial number of carpets in a compact volume. Display conveyor assembly 40 is preferably about 18 feet long and 13 feet wide and 6 inches off the floor. In this manner, it is easy for a customer who wishes to consider purchasing a rug to step up and to walk on the rug while viewing the rug from the normal viewing position.

While various materials can be used for the construction of display belt 12, the material known as vinyl is preferable. However, display belt 12 could also be fabricated from a rubber material such as neoprene fiber reinforced belt or other similar material. The material selected must be such that it prevents damage to the carpets when left in a rolled position for an extended period of time.

Display belt 12 can be attached to roller 16 in several different ways. The preferred method is to provide a simple slit in each roll with the end of display belt 12 being slid into the slit and clamped or held simply by friction.

Another method could use a short belt, which is permanently attached to the rollers and contains either snap type grommets or a VELCRO type strip, which connects to a similar grommet, or strip located on the end of the display belt 12. A third alternative would be the use of a rigid strip, which is located on the edge of the roller 16 and which can be tightened down on top of the end of the display belt 12.

Roller 16 is preferably made out of steel having a diameter of about 8 inches and a length of about 13 feet. Preferably roller 16 as well as the other rollers in the supply assembly will be slightly longer than the width of display belt 12 so that the edges of display belt 12 do not protrude over the roller's edges.

Display belt 12 includes indexed markings 50, which provide a means for identifying particular points along the length of display belt 12. The markings can either indicate a distance along display belt 12 spaced one or more feet apart to indicate "foot" marks or a bar code could be used to allow a sensor to display the display belt 12 position.

While it is anticipated that the use of the "flax guard" material will ensure that the carpets will stay in position while being displayed, the use of more secure methods can also be utilized. The carpets 15 can be securely attached to the display belt 12 in a variety of ways. For example, VELCRO type strips 13 running lengthwise along each side of the display belt 12 could be used, or, optionally, in the middle of display belt 12.

Display belt 12 with the attached carpets is rolled onto roller 16 by conveyor 42. Once display belt 12 is completely rolled onto roller 16, the carpets are available for display but can be kept in this position, safe from theft or damage, yet, compactly stored.

As display belt 12 and the attached carpets are wound onto roller 16, roller 16 which is rotatably attached to a vertical frame 14 at both ends by a sliding attachment, rides upward in vertical frame 14, assisted by hydraulic lifts 102 located at both ends of vertical frame 14, with roller 16 and the wound-up display belt 12 being supported along the length of the wound-up roller by drive conveyor belt 42. The weight of roller 16 against conveyor belt 42 provides a friction so that the rotation of conveyor belt 42 similarly causes roller 16 to rotate.

As shown in FIG. 2, drive conveyor belt 42, in addition to serving as the driving force to wind and unwind roller 16, acts as a cradle to support roller 16 over a greater surface area than if roller 16 would be permitted to rest on a hard surface. Without the cradle support provided by drive conveyor belt 42, fragile carpets such as extremely valuable oriental rugs would likely be damaged.

Figure 7:
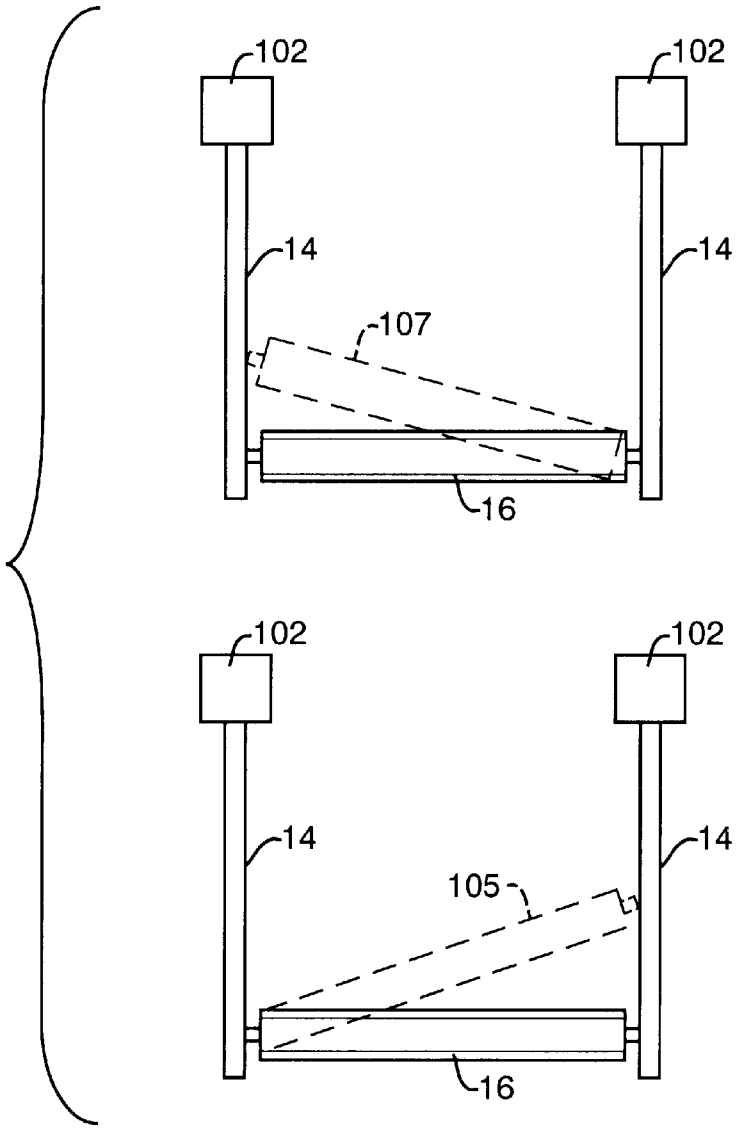
FIG. 7 illustrates the steering portion of the steering and brake assembly depicting the movement of one roller with respect to the other.

Preferably positioned near the top of each end of vertical frame 14 is a hydraulic lift 102. Each hydraulic lift 102 is attached to the ends of rollers 16. Hydraulic lifts 102 are controlled by control panel 60. As end 105 of roller 16 is lifted as shown in FIG. 7 (greatly exaggerated in the figure in order to illustrate the principle), the opposite end 107 of the other roller 16 is lifted by a corresponding amount. In this manner, the display belt 12 is controlled so that display belt 12 is evenly wound upon the roller 16 of the take-up assembly. If display belt 12 is not evenly wound upon roller 16 as display belt 12 is unwound from the other roller 16, then carpets 15 could be damaged.

Preferably, lift 102 should be capable of lifting up to 5,000 pounds since, as the roller 16 with its display belt 12 along with the carpets and rugs gets larger, less steering should be required. However, lifts 102 having a lifting capacity of greater than 5,000 pounds could also be used if desired. Lifts 102 are controlled via control panel 60. Lifts 102 are attached to rollers 16 using methods that are well known in the art.

Lifts 102 can also be used to lift the entire roller 16 rather than just one end when roller 16 is functioning as the supply roller. This will eliminate slack in the display belt 12, as it is unwound from roller 16. This is necessary only on the roller 16, which is serving to unrolling display belt 12. The roller 16, which is winding up display belt 12, does not have to be so lifted. As a further precaution against having any slack in display belt 12 as the winding/unwinding process is in operation, brakes 104 (shown in FIG. 3) can be fitted to both rollers 16 at one or both ends. Brake 104 would be activated on the roller 16, which is being unrolled so that no slack in display belt 12 occurs. If slack in display belt 12 were permitted to occur, then the carpets and rugs attached to display belt 12 could buckle up on the inside, thus potentially damaging the carpets and rugs attached thereto. Thus, brake 104, also under the control of panel 60, functions as a tensioning device to ensure that display belt 12 is always tight. Brakes 104 can be any type of brake that is well known in the art, such as a disk brake that is fitted to an automobile.

Drive conveyor belt 42 is preferably about 6 feet wide so that ample support and drive force for roller 16 can be obtained. By having roller 16 indirectly rotated through its contact with conveyor belt 42 rather than having a direct drive, the cost to manufacture the unit is substantially less without any compromise in protecting the rugs from being crushed.

Drive conveyor belt 42 is preferably a plurality of 4 inch wide belts, however, other configurations could also be utilized, even a single belt of conveyor material. Any conveyor belt material well known in the art is acceptable as long as the material selected has a sufficient coefficient of friction so that it may easily drive roller 16 and the display belt 12 without unduly slipping.

Drive conveyor belt 42 is powered by connecting preferably a 5 horsepower electric motor 18 via a transmission 32 and belt 22 to drive roller 20. Guide rollers 30 help keep drive conveyor belt 42 properly tensioned and positioned when the full weight of fully wound roll 34 (display belt 12 and the attached rugs) is supported thereon. Drive roller 36 is rotated by conveyor belt 42. Conveyor belt 26 of display conveyor assembly 40 is powered by drive roller 36 being rotatably connected, via belt/chain 28, to roller 38. Clutch 24 is provided on roller 38 to complete the supply assembly 11.

As shown in FIG. 3, a top view of the supply assembly 11 shows roller 16 being centered in conveyor belt 42 so that conveyor belt 42 can serve as a support for the fully loaded roller 16.

Take-up assembly 72 (shown in FIG. 4) has exactly the same components as supply assembly 11 positioned at the other end of display conveyor assembly with its drive roller 36 adjacent to another roller 38 at the other end of conveyor belt 26. In this manner, a substantial identical take-up assembly 72 can serve as supply assembly 11 when it is fully wound with display belt 12 and the attached carpets and supply assembly 11 can then serve as take-up assembly 72.

Figure 4:
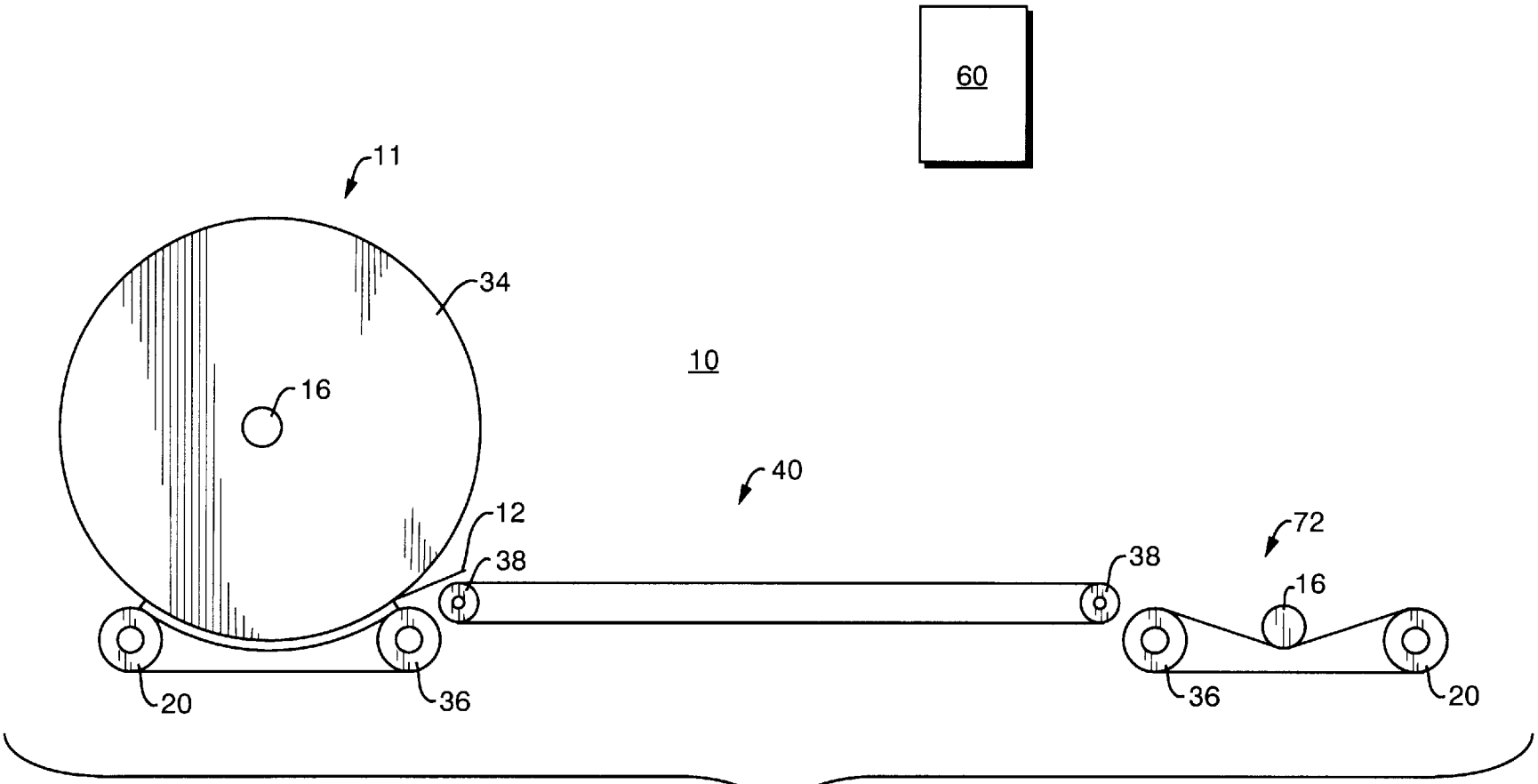
FIG. 4 is a schematic of the display apparatus depicting the movement of the display belt with the attached carpets that are to be viewed.

FIG. 4 is a schematic of the display apparatus 10 depicting the movement of the roll 34 from left to right, that is, from the supply assembly 11, over the display conveyor 40 so that the rugs can be viewed, to the take-up assembly 72. Control panel 60 activates the motors 18, transmissions 32 and clutches 24 so that roll 34 can either wind or unwind so that a particular carpet can be viewed. Once in position on display conveyor 40, a rug will be in its normal horizontal viewing position so that a potential customer may even walk upon it in order to consider purchase.

To unwind roll 34, supply assembly drive motor 18 and transmission 32 is activated so that roller 20 rotates clockwise. The Clutch 24 on the left is engaged while the clutch 24 on the right is disengaged. This causes conveyor belt 42 and drive roller 36 to also rotate clockwise. Roller 16 and attached roll 34 will then rotate counterclockwise, thus, causing roll 34 to unwind. Drive roller 36, with its clutch 24 engaged, via belt/chain 28 connected to roller 38 results in conveyor belt 26 also rotating in a clockwise manner, feeding display belt 12 towards take-up assembly 72.

Control panel 60 also activates motor 18 and transmission 32 of take-up assembly 72, which is at the opposing end of conveyor assembly 40. To wind up display belt 12 on its roller 16, roller 16 must rotate also rotate counterclockwise. As with supply assembly 11, take-up assembly 11's roller 20, conveyor belt 42, and roller 38. When moving conveyor 26 from right to left, the clutch 24 on the right is engaged while the clutch 24 on the left is disengaged. In this manner, proper tension is kept on conveyor 26 to keep smoothly operating in the intended direction. Conveyor 26 and conveyor assembly 40 must be sufficiently sturdy to enable a user to stand on it so that the carpets can be viewed.

Figure 5:
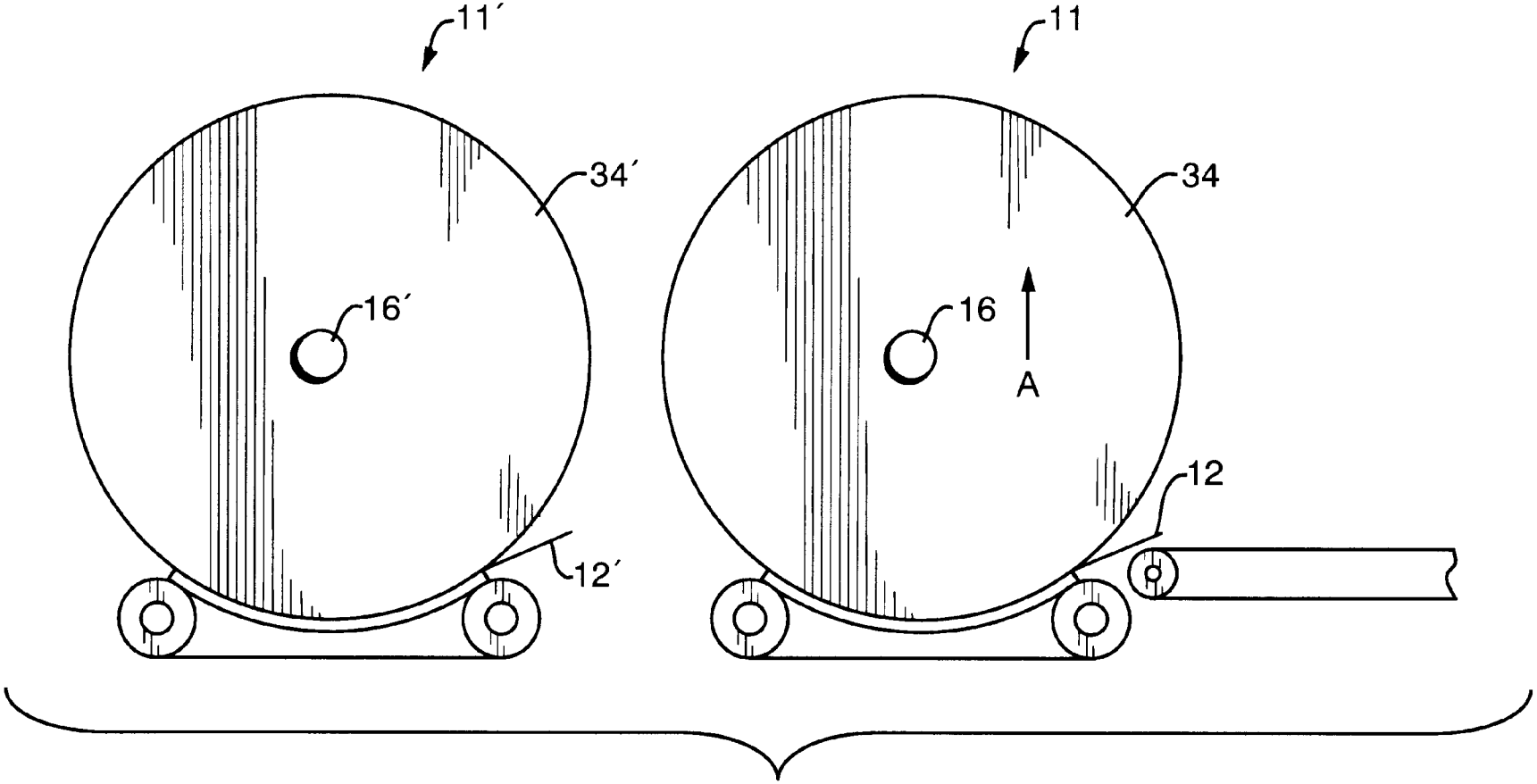
FIG. 5 is a schematic of an alternative embodiment of the display apparatus depicting the movement of a secondary display belt with different attached carpets that are to be viewed.
Figure 6:
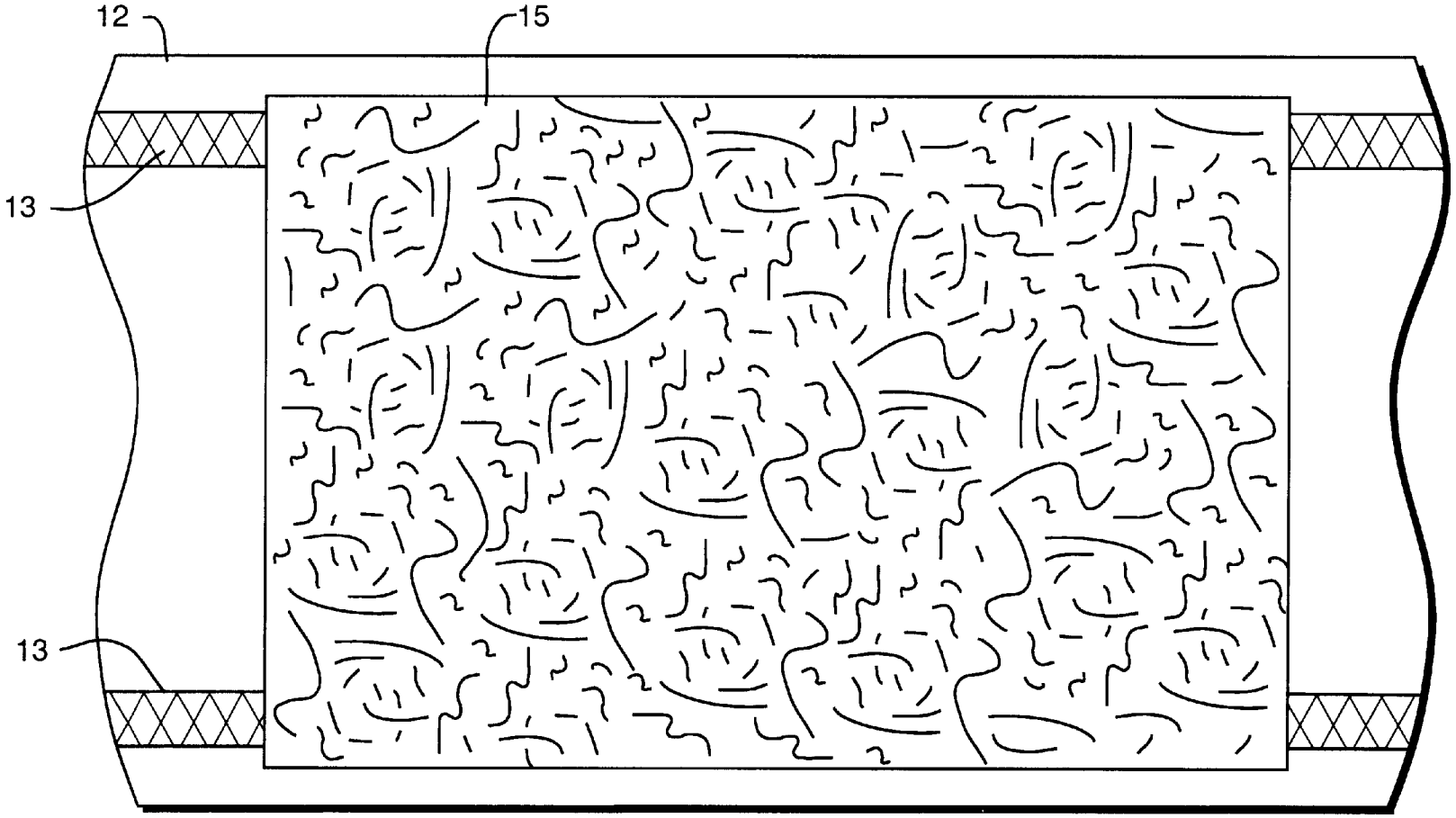
FIG. 6 is a top view of one embodiment of the display belt of the display apparatus of the present invention.

FIG. 5 is a schematic of an alternative embodiment of the display apparatus depicting the movement of a secondary display belt 12' with different attached carpets that are to be viewed. In this embodiment, roll 34 of supply assembly 11 is lifted via roller 16 so that it no longer contacts conveyor belt 42. The secondary display belt 12' from the secondary supply assembly 11' is positioned next to supply assembly 11 and secondary display belt 12' is fed under roll 34 so that secondary display belt 12' contacts conveyor belt 42. From there, secondary display belt 12' is fed to conveyor assembly 40 and then to take-up assembly 72 as before. In this manner, numerous rolls of carpets can be stored and later viewed, occupying far less storage space than if the rugs were stored and viewed in the usual manner.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A display apparatus for displaying a plurality of carpets in a substantially horizontal position comprising:

a display belt, having a length and a width, for supporting the plurality of carpets in the horizontal position;

a supply assembly comprising:

a roller, having a length and two axial ends, wherein said display belt is wound onto said roller;

a vertical stand having spaced apart vertical members;

a sliding attachment rotatably attaching said roller between said vertical members such that said roller is free to rotate and move up and down in a vertical direction;

a motor-driven conveyor, connected to said stand, for rotating said roller and supporting said roller along the length of said roller;

a take-up assembly for winding up said display belt with the attached carpets that is provided by said supply assembly, said take-up assembly being substantially identical to said supply assembly such that take-up assembly can serve as said supply assembly when said display belt with the attached carpets is wound upon said take-up assembly, with said supply assembly then serving as said take-up assembly to transfer said display belt with the attached carpets back again to said supply assembly;

a display conveyor, said display conveyor rotationally connected to said take-up assembly and said supply assembly, and, disposed between said take-up assembly and said supply assembly, said display conveyor being structured for supporting and assisting the movement of said display belt with the attached carpets from one said assembly to the other said assembly so that the carpets can be viewed in the horizontal position by a user standing on the carpets on said display conveyor.

2. The display apparatus of claim 1 further comprising:

a supply lift assembly attached to said supply assembly such that activating said supply lift assembly causes said roller to move upward in said stand; and a take-up lift assembly, substantially identical to said supply lift assembly, said take-up lift assembly being attached to said take-up assembly, such that if one axial end of said supply lift assembly roller is higher in the corresponding vertical stand than the other axial end of said supply lift assembly roller, said take-up lift assembly is activated to raise the opposite axial end of the roller of said take-up assembly a corresponding vertical distance, thereby causing said display belt to wind evenly on the roller of said take-up assembly.

3. The display apparatus of claim 1 wherein both axial ends of said supply assembly roller are adapted to be raised to raise the roller in the corresponding vertical stand when said supply assembly roller is unwinding said display belt and said take-up assembly roller is winding up said display belt, thereby tensioning said display belt to prevent slack occurring in said display belt during the winding and unwinding of the rollers.

4. The display apparatus of claim 1 further comprising:

a supply roller brake attached to the roller of said supply assembly;

a take-up roller brake, substantially identical to said supply roller brake, said take-up roller brake being attached to the roller of take-up assembly, such that said supply roller brake is activated when display belt is being unwound from the roller of said supply assembly thereby tensioning said display belt to prevent slack occurring in said display belt.

5. The display apparatus of claim 1 further comprising:

indicating means for indicating an approximate point along the length of said display belt where one of said plurality of carpets is located, such that said take-up assembly, said supply assembly, and said display conveyor may move said display belt to the approximate point along the length of said display belt where said one preselected carpet is located so that said carpet can be viewed.

6. The display apparatus of claim 1, wherein said display apparatus further comprises attaching means for releaseably attaching the carpets to said display belt.

7. The display apparatus of claim 1, wherein the length of the roller of said supply assembly and the length of the roller of said take-up assembly corresponds to is the width of said display belt.

8. The display apparatus of claim 1, wherein said display conveyor further comprises:

a supply display drive assembly rotationally attached to said supply assembly and a take-up display drive assembly rotationally attached to said take-up assembly.

9. The display apparatus of claim 8, wherein said supply display drive assembly and said take-up display drive assembly are substantially identical.

10. The display apparatus of claim 9 wherein both said supply drive assembly and said take-up drive assembly rotationally connect to said display conveyor via a drive belt.

11. The display apparatus of claim 10 wherein said supply drive assembly further comprises a clutch and said take-up assembly further comprises a clutch, with said clutches being substantial identical.

12. The display apparatus of claim 11 further comprising a control, and wherein said control actuates the clutch of said supply drive assembly independently from the clutch of said take-up assembly.

13. The display apparatus of claim 1 further comprising a secondary supply assembly, positioned adjacent to said supply assembly, said secondary supply assembly being substantially identical to said supply assembly, wherein said secondary supply assembly displays a secondary display belt with different attached plurality of carpets and wherein by raising said roller of said supply assembly away from said motor-driven conveyor and feeding said secondary supply assembly to contact said motor-driven conveyor, said display conveyor and said take-up assembly moves said secondary display belt so that the different attached plurality of carpets can be viewed in the horizontal position by the user.

* * * * *